US006369714B2

(12) United States Patent
Walter

(10) Patent No.: US 6,369,714 B2
(45) **Date of Patent: *Apr. 9, 2002**

(54) WATER LEAK DETECTION AND CORRECTION DEVICE

(76) Inventor: Scott A. Walter, 28896 Mountain View La., Trabuco Canyon, CA (US) 92679

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/528,924

(22) Filed: Mar. 20, 2000

Related U.S. Application Data

(60) Provisional application No. 60/124,968, filed on Mar. 18, 1999.

(51) Int. Cl.[7] ..... G08B 21/00

(52) U.S. Cl. ..... 340/605; 340/604; 340/618; 340/620

(58) Field of Search ..... 340/605, 604, 340/618, 620; 137/803, 804, 805, 312, 551

(56) References Cited

U.S. PATENT DOCUMENTS 4,180,088 A * 12/1979 Mallett ..... 137/87
4,297,686 A 10/1981 Tom
4,324,268 A * 4/1982 Jacobson ..... 137/312
4,572,113 A 2/1986 Baughman
4,593,275 A 6/1986 Bazandjoglou
4,804,947 A 2/1989 Geleziunas
5,058,421 A 10/1991 Alexander et al.
5,240,022 A 8/1993 Franklin
5,311,100 A 5/1994 Brain
5,334,973 A 8/1994 Furr
5,655,561 A 8/1997 Wendel et al.
5,782,263 A 7/1998 Isaacson, Jr. et al.
5,966,076 A 10/1999 Cantrell
5,967,171 A 10/1999 Dwyer, Jr.
5,992,218 A 11/1999 Tryba et al.
6,025,788 A 2/2000 Diduck
6,057,770 A 5/2000 Justesen
6,186,162 B1 2/2001 Purvis et al.

* cited by examiner

*Primary Examiner*—Julie Lieu
(74) *Attorney, Agent, or Firm*—Knobbe, Martens, Olson & Bear LLP

(57) ABSTRACT

A water leak detection apparatus comprises a sensor, a control unit and a valve module. The sensor is adapted to be placed below a water line or coupling. The valve module is positioned as far upstream on a water line as possible. The control unit actuates the valve module and an audible alarm when the sensor detects a water leak. The valve module closes a valve positioned along the water line to restrict flow through the water line until the control unit has been manually reset. The control unit also features a trigger button to allow the valve to be manually cycled for cleaning, for instance.

5 Claims, 4 Drawing Sheets

WATER LEAK DETECTION AND CORRECTION DEVICE

RELATED APPLICATIONS

This application is related to and hereby claims priority to U.S. Provisional Patent Application No. 60/124,968, filed Mar. 18, 1999, the disclosure of which is hereby expressly incorporated by reference.

BACKGROUND OF THE INVENTION

1. Field of the Invention

The present invention generally relates to systems designed to detect water leaks. More specifically, the present invention relates to systems designed to shut off a water supply to individual appliances if water leaks are detected.

2. Related Art

Household flooding costs homeowners and insurance companies more than $100 million every year in the United States alone. Such household flooding can be caused by bursting pipes or malfunctioning appliances, for instance. The resultant flooding often causes damage to the surrounding environment as well as to the appliance itself For example, flooding of laundry rooms is such a common occurrence that many housing codes now require washing machines to be positioned within catch basins. Thus, when the inevitable overflow occurs, it is hoped that the water will be contained within the catch basins and that the water will not flow into other regions of the laundry rooms. However, unless the manually operated shut-off valves, which are typically positioned at the wall behind most washing machines, are closed, water can surge unrestricted through a burst supply hose or can spill from the tank of the malfunctioning washing machine. It is estimated that the unrestricted flow through the hoses or from the tanks can be on the order of 3 gallons per minute or 180 gallons an hour. Clearly, in an unmonitored situation, the flow of water will rapidly exceed the storage capacity of a catch basin and also can exceed the capacity of a drain positioned within the catch basin.

In addition, toilets can be a source of flooding as well. Generally, toilets include both a float valve and a seal that stops the flow of water into the toilet; however, if the drain line becomes plugged, or if the float valve or seal malfunctions, water can spill from within the toilet bowl or refill tank onto the floor. In addition, the supply line can become loosened or can fail. In such instances, fresh water will be surging onto the bathroom floor until the manually operated valve, which is typically located behind the toilet, is shut off. Thus, large amounts of water can flood a bathroom if the condition remains unmonitored.

SUMMARY OF THE INVENTION

In view of the above problems, among others, a leak detection and restriction device has been developed.

Accordingly, one aspect of the present invention involves a water leak detection and correction device comprising a circuit having a power source having a first terminal and a second terminal. The first terminal of the power source is connected to a first terminal of a relay coil. The relay coil has a second terminal that is connected to a first terminal of a liquid sensor. The liquid sensor has a second terminal that is connected to the second terminal of the power source. The device also comprises a normally open latching relay having a first terminal and a second terminal. The latching relay is connected to the circuit in parallel with the liquid sensor. The latching relay is operatively controlled by the relay coil such that the latching relay is closed when current flows through the relay coil. The device further comprises a first electrically operated valve having a first terminal and a second terminal. The first terminal of the first electrically operated valve is connected to a first terminal of a power supply and the second terminal of the first electrically operated valve is connected to a first terminal of a normally open first relay. The first relay has a second terminal that is connected to a second terminal of the power supply and the first relay is operatively controlled by the relay coil such that the first relay is closed when current flows through the relay coil.

Another aspect of the present invention involves a water leak detection and correction device comprising a liquid sensor, a control unit and a valve module. The control unit is electrically connected to the liquid sensor and is electrically connected to the valve module. The liquid sensor transmits a positive signal when liquid is detected. The control unit receives the positive signal and transmits a control signal to the valve module when the positive signal is received. The valve module receives the control signal and operates to close at least one valve in response to the control signal. The at least one valve is secured in a closed position even when the positive signal is no longer received by the control unit.

BRIEF DESCRIPTION OF THE DRAWINGS

These and other features, aspects and advantages of the present invention will now be described with reference to the drawings of certain preferred embodiments, which embodiments are intended to illustrate and not to limit the invention, and in which figures.

DETAILED DESCRIPTION OF THE PREFERRED EMBODIMENTS OF THE INVENTION

Figure 1:
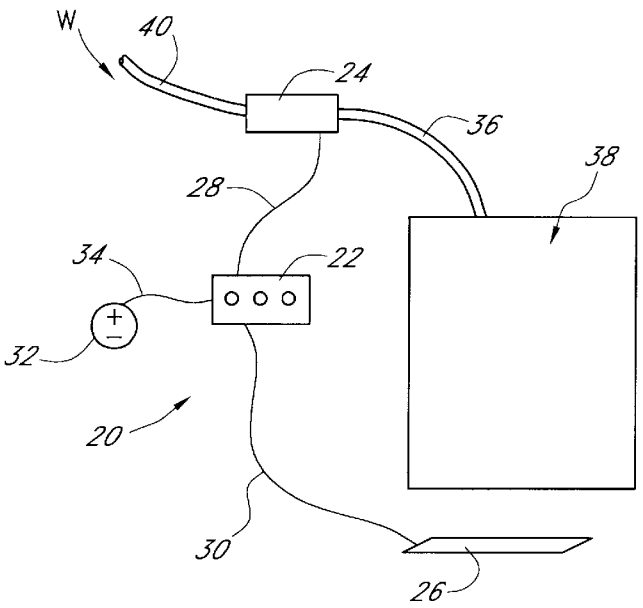
FIG. 1 is a schematic diagram of a leak detection and restriction apparatus arranged and configured in accordance with certain features, aspects and advantages of the present invention.

With reference now to FIG. 1, a schematic diagram of a leak detection and restriction apparatus having certain features, aspects and advantages in accordance with the present invention is illustrated. The apparatus, indicated generally by the reference numeral 20, is used to detect leaks and to take corrective action in the event of leaks. As illustrated, the apparatus 20 generally is designed for everyday household use; however, it should be readily apparent to those having ordinary skill in the relevant arts that the apparatus 20 can be used in a variety of other environments. In addition, the apparatus 20 can be modified to detect other types of leaks, such as leaks comprising gases and/or liquids other than water, for example.

In the illustrated arrangement, the apparatus generally comprises a control module 22 that communicates with a valve module 24 and a sensor 26. The control module 22 preferably is electrically connected to the valve module 24 through an electrical signal wire 28. Of course, the control module can be connected to the valve module through other arrangements, however, the use of an electrical signal wire is preferred for simplicity and dependability. In addition, in some other arrangements, the control module communicates with the valve module through electromagnetic waves, infrared waves, radio waves or other similar remote connection configurations.

The control module 22 also preferably is in electrical communication with the sensor 26 through an electrical signal wire 30. Of course, the two components 22, 26 can communicate through other suitable arrangements, whether the arrangements are hard wired or transmitter-receiver types.

The control module 22 receives power from a power source 32 through a suitable connection line 34. The power source can be AC or DC depending upon the application. In some applications, the power source can be AC rectified or transformed into DC. In one arrangement, the power source 32 is a standard wall outlet. In another arrangement, the power source 32 is a battery, such as a standard 9volt cell. Of course, more than one power source 32 can be provided for use as a power backup, for example. In some environments where the ability to monitor leaks even during power outages is desired, the use of an arrangement powered by a battery or other stored power arrangement might be preferred. In other environments where the need to monitor leaks is largely dependent upon whether power is being supplied to a near-by appliance, the use of an arrangement powered by a standard wall outlet might be preferred such that battery replacement does not become a concern.

Preferably, the present arrangement 20 is positioned proximate a water supply line 36 that leads to an appliance 38. In some arrangements, the appliance 38 is a washing machine. In other arrangements, the appliance 38 can be a dish washer, a water heater, a toilet, a sink or the like. The valve module 24 preferably is positioned along-the supply line 36. More preferably, in arrangements in which the supply line 36 is a hose connected to a plumbed line 40 including a wall spigot, the valve module 24 is directly connected to the plumbed line 40 at the wall spigot and is interposed between the plumbed line 40 and the supply line 36. By directly attaching the valve module 24 to the plumbed lines 40 (which are generally copper or galvanized metal), the valve module 24 advantageously is positioned upstream of a rubber or elastomeric hose that could rupture under normal everyday use.

The valve module 24 can comprise one or more valves that can be opened and closed without manual intervention. In arrangements for use with appliances such as washing machines, two valves preferably are used such that one valve can be used for each water supply line (i.e., one hot water line and one cold water line). Of course, the number of valves can be varied according to the number of supply lines being monitored. In addition, while the present invention is being described in the context of supply lines, the present invention also can be used with drain lines and transfer lines, as well. In the illustrated arrangement, the valves are solenoid operated valves, such as those well known to those of ordinary skill in the relevant arts. In other arrangements, other types of suitable automatic valve assemblies can be used, such as motor-driven assemblies, for instance. In addition, the valve module 24 can be powered by a power supply that is separate from the power source 32.

Of course, as will be understood from the description below, the valves are preferably of the "normally open" type, which allow water to flow until triggered to close. Because the presently preferred valves are actuated by solenoids, the valve remains closed only so long as power is supplied to the solenoid. After the power is removed, the solenoid is de-energized and the valve is allowed to reopen. Of course, the valve can be constructed to open and close and to remain in either position regardless of whether the power is removed. For instance, the valve may toggle from open to closed through a single application of power. In addition, in some arrangements, the valves may be of the "normally closed" type and can be driven to the open state only so long as power is applied. In such an arrangement, if the power supply is removed (i.e., power black-out or drained battery), the flow is advantageously interrupted such that leaks during power outages can be obviated.

The sensor 26 can be constructed to form a closed circuit when a conductive liquid contacts the surface of the sensor 26. Preferably, the sensor 26 is located proximate a water connection or hose. In this position, the sensor 26 is most likely to be contacted by leaking water. As described above, any contact with water acts to close a circuit, which will be described below. When the circuit is closed, an alarm can be activated and/or the emergency valves can be actuated to stop the flow of water to or from the appliance 38. In one arrangement, the sensor is a tin-lead or zinc coated copper device well known to those of ordinary skill in the relevant arts. Of course, other types of sensors that could be used with certain other features, aspects and advantages of the present invention also are well-known.

Figure 2:
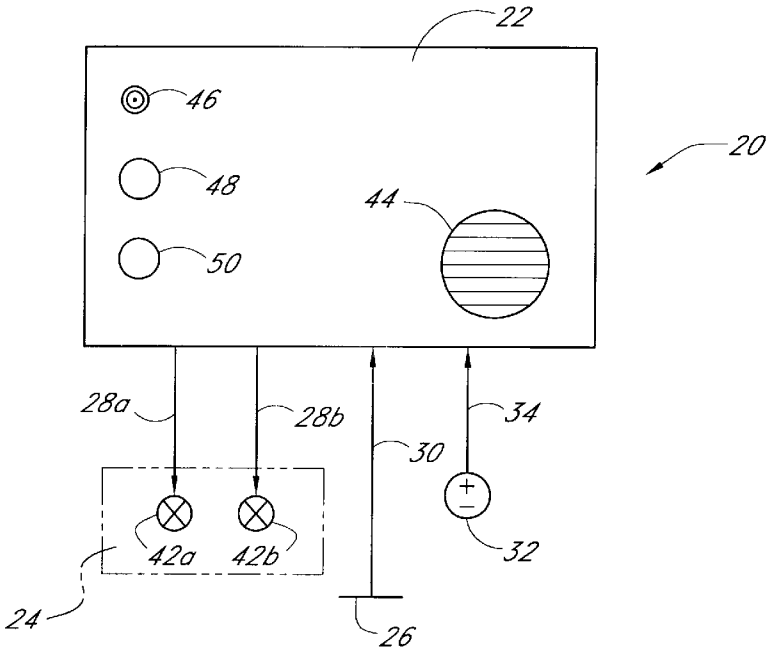
FIG. 2 is a schematic diagram of a control module of the leak detection and restriction apparatus.

With reference now to FIG. 2, the present control module 22 is illustrated. The control module 22, as discussed above, preferably is connected to a sensor 26 and a valve module 24 through connecting lines 28, 30. The control module 22 can include a circuit board, processor or another suitable type of circuitry. Of course, the number of connecting lines 28 extending to the valve module 24 can match the number of valves 42 used in the valve module 24. For instance, a first line 28*a* can extend to a hot water valve 42*a* while a second line 28*b* can extend to a cold water valve 42*b*. While a sensor, such as a temperature sensor, could be included to determine the source of a leak whereby flow through only the source of the leak could be thwarted, such an arrangement is not illustrated.

The illustrated control module 22 also preferably comprises a speaker 44 and a visual indicator 46. The indicator 46 can comprise an LED or the like. In some arrangements, when a leak has been detected, an alarm may sound through the speaker 44, which can be a standard speaker or other audible energy source. The visual indicator 46 can be used to indicate a system-ready status, or an alarm status, for instance. In some arrangements, the visual indicator 46 can be used to indicate the strength of a power cell such as a battery. In the presently preferred arrangement, the light is used to indicate that the device is powered up. In other arrangements, the speaker 44 and/or the visual indicator can be powered by a power supply that is separate from that powering the detection circuitry.

With continued reference to FIG. 2, the control module 22 can comprise a reset button 48 to reset the system 20 after a leak has been detected. In addition, the illustrated control module 22 includes a manual activation button, or trigger button, 50 that can be used to manually shut off flow through the valves 42*a*, 42*b*. Such a capability is desired for many reasons. One reason, however, relates to preventative maintenance of the system. In some environments of use, so-called hard water will be circulating through the valves 42*a*, 42*b*. In such environments, the illustrated valves 42*a*, 42*b* can be cycled to clean the valves of scale and other mineral deposits. By periodically cycling the valves 42*a*, 42*b*, it is hoped that the life expectancy of the valves 42*a*, 42*b* can be increased. The trigger button 50 can either function as a trigger button 50 can activate the valves in such a manner that the reset button 48 is used to reset the control module 22 and valves 42*a*, 42*b*. The control module also can be programmed to automatically cycle the valves on a regular basis, such as every month. Thus, connections can also be provided between the reset button and the trigger button and the control unit.

Figure 3:
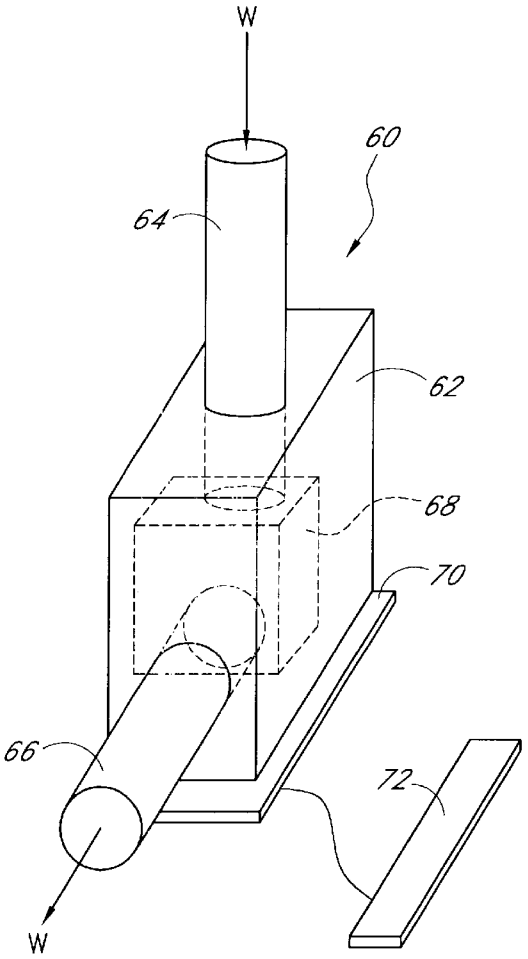
FIG. 3 is a schematic diagram of an integrated control module of another leak detection and restriction apparatus.

With reference now to FIG. 3, another apparatus 60 is illustrated therein. The apparatus 60 generally comprises the same components as the apparatus 20 described above.

The main difference between the two apparatuses, however, lies in the integrated construction of the apparatus 60 relative to the construction of the apparatus 20. The apparatus 60 generally contains each component within a single housing 62. Preferably, the apparatus 60 also contains a power cell, such as a battery, within an easily accessed battery compartment. In this manner, the apparatus 60 can be maintained without removing the apparatus 60 from its inline position along the supply line. In addition, by including a battery, the water flow is not positioned in close proximity to a standard household power supply line. The water flows in through a water inlet 64 and out through a water outlet 66. A valve, which is schematically illustrated at reference numeral 68, is interposed between the inlet 64 and the outlet 66. The valve 68 and a control unit 70, therefore, are integrated into a single unit. Of course, more than one valve 68 can be included in the unit and the unit can control any number of valves separately or together. A sensor 72 preferably is remotely located from the housing but can be integrated into the housing in some arrangements.

Figure 4:
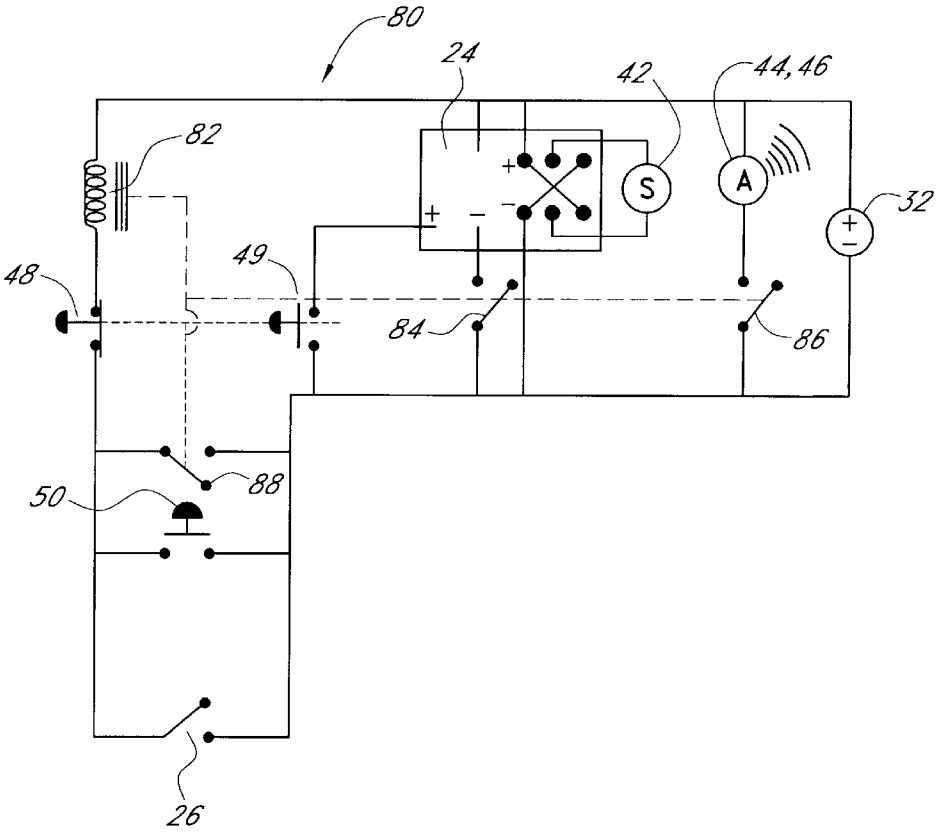
FIG. 4 is a circuit diagram of one implementation of a leak detection and restriction apparatus that is arranged and configured in accordance with certain features, aspects and advantages of the present invention.

With reference now to FIG. 4, a first circuit 80 that can be used to implement a basic apparatus having certain features, aspects and advantages in accordance with the present invention is illustrated. As shown, power is supplied from the source 32 to the circuit 80. The current flows through the normally closed reset switch 48 in the illustrated arrangement. The current is interrupted by the trigger switch 50 and the sensor 26 in the illustrated arrangement. Both of these components are normally opened in the illustrated circuit 80. When either or both of these components closes, the circuit is completed and the current flows to the alarm 44, 46 and to the valve module 24. Any suitable valve control circuit 24 known to those of ordinary skill in the art can be used. As will be explained, the circuit 80 remains closed and the water flow through the valves 42 is interrupted by the valve module 24 and the alarm 44, 46 continues to be activated until the reset switch 48 is opened. When the illustrated reset switch 48 is operated, the valves 42 are opened and the alarm 44, 46 is deactivated.

When the reset switch 48 is opened, the current is removed from a coil 82 and the valves relax back to an open position. The coil 82 acts to control a variety of contacts in the illustrated arrangement. For instance, when current flows through the coil 82, a first contact 84 reacts and power is supplied to the valve module 24 associated with the valve 42. Thus, current flowing through the coil 82 causes the valve 42 to be closed. In addition, current flowing through the coil 82 causes a second contact 86 to react such that current is applied to the alarm 44, 46. Furthermore, current flowing through the coil 82 causes a third contact 88 to react. The third contact 88 is a latching contact that is used to maintain the flow of current until the reset switch 48 is actuated, such as by pressing a reset button. Thus, the third contact 88 ensures that current remains flowing even if the water dries before the reset button is activated. The reset switch 48 is also connected to a valve module reset 49 that operates to unlatch the valve 42. Thus, when current is provided to the module 24, the valve 42 is latched in a closed position and held in the closed position until the valve module reset 49 is actuated.

Figure 5:
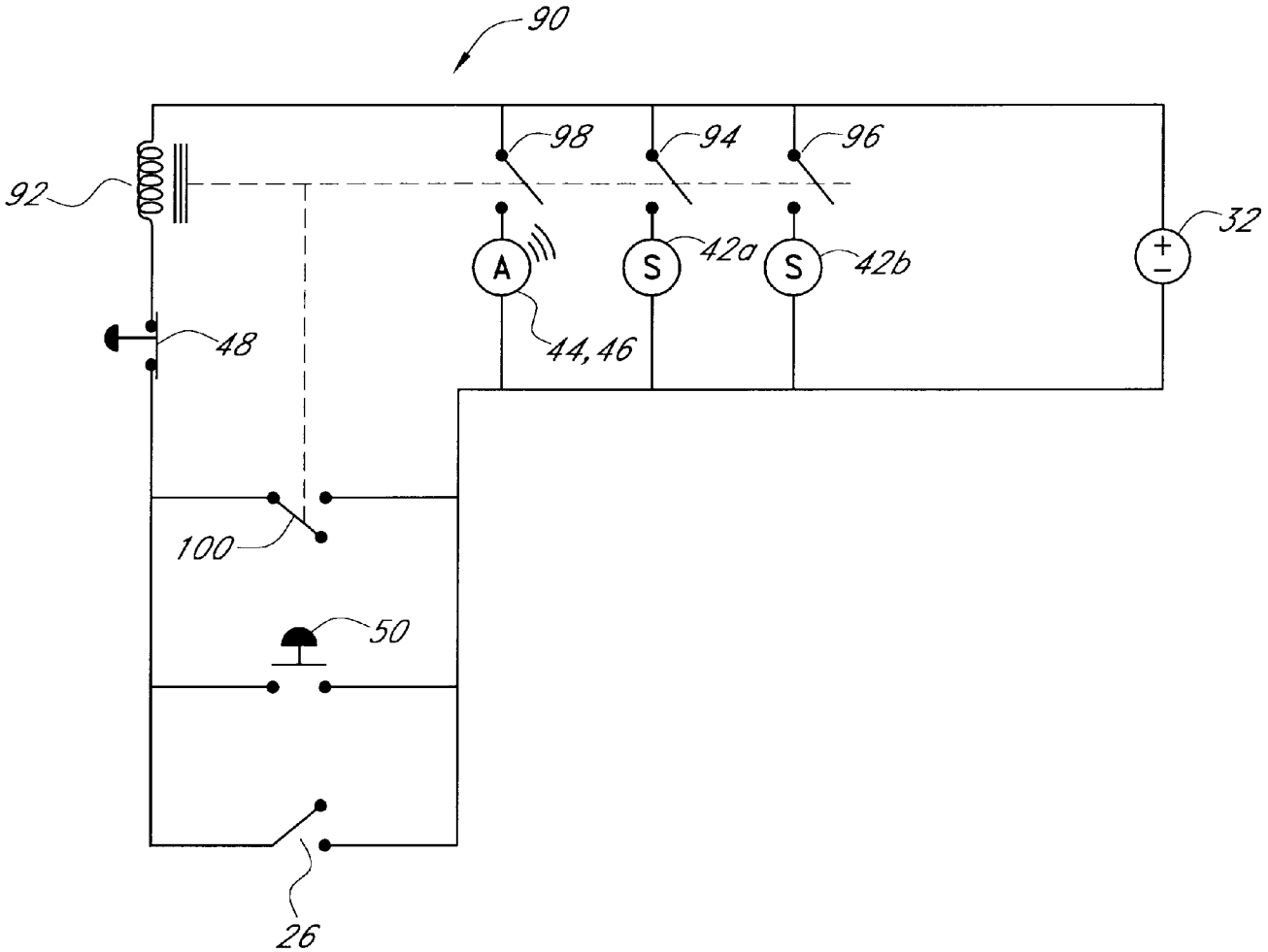
FIG. 5 is a circuit diagram of another implementation of a leak detection and restriction apparatus that is arranged and configured in accordance with certain features, aspects and advantages of the present invention.

With reference now to FIG. 5, another circuit 90 that can be used to implement a basic apparatus having certain features, aspects and advantages in accordance with the present invention is illustrated. As shown, power is supplied from the source 32 to the circuit 90. Power in the form of current is provided from the power source 32 to the circuit 90. The current can flow through the normally closed reset switch 48 and the current flow is interrupted by the normally open trigger switch 50 and the normally open sensor 26. When either, or both, the switch 50 and/or the sensor 26 is closed, current flows to the alarm 44, 46 and the valves 42*a*, 42*b* are closed.

When the reset switch 48 is opened, the current is removed from a coil 92 and the valves relax back to an open position. The coil 92 acts to control a variety of contacts. For instance, when current flows through the coil 92, a first contact 94 and a second contact 96 react and power is supplied to solenoids associated with the valves 42*a*, 42*b*. Thus, current flowing through the coil 92 causes the valves 42*a*, 42*b* to be closed. In addition, current flowing through the coil 92 causes a third contact 98 to react such that current is applied to the alarm 44, 46. Furthermore, current flowing through the coil 92 causes a fourth contact 100 to react. The fourth contact 100 is a latching contact that is used to maintain the flow of current until the reset switch 48 is actuated, such as by pressing a reset button. Thus, the fourth contact ensures that current remains flowing even if the water dries before the reset button is activated.

Figure 6:
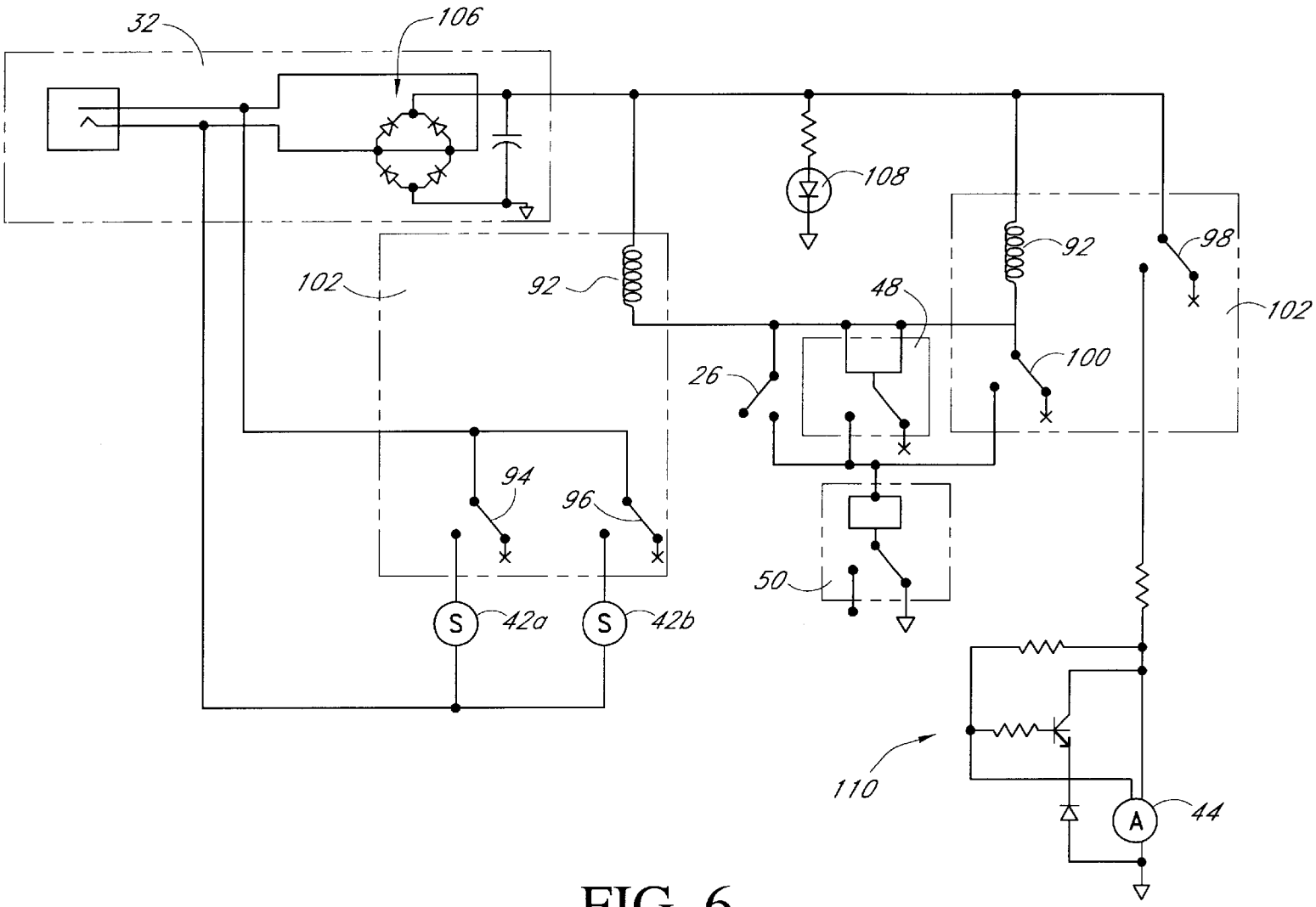
FIG. 6 is a circuit diagram of a further implementation of a leak detection and restriction apparatus that is arranged and configured in accordance with certain features, aspects and advantages of the present invention.

With reference now to FIG. 6, another implementation of the present invention in a circuit is illustrated therein. In this implementation, a pair of coils 92 (i.e., a pair of relays 102) are used with a DC power source 32. Two coils 92 are used in the illustrated arrangement as a result of power demands and cost savings. It is anticipated that more than two coils 102 also can be used. In the illustrated arrangement, one coil 92 operates the relay that powers the valves 42*a*, 42*b* while the other coil 92 operates the alarm 44. The illustrated arrangement also includes a power-on indicator 108 that illuminates to indicate that the device is operational.

As indicated directly above, the power source 32 preferably is DC. The illustrated arrangement of FIG. 6 features an AC power supply that is converted into a DC power source for the relays and left as an AC power source for supplying energy to the valve actuators 42*a*, 42*b*. Preferably, the power supply is converted through a diode bridge 106 in a known manner. While other types of conversion techniques are well known and suitable, the illustrated diode bridge 106 reduces cost and increases dependability.

With continued reference to FIG. 6, the self-contained alarm disclosed above has been replaced by a piezo alarm 44 with a driving circuit 110 in the illustrated arrangement.

While other arrangements are preferred, the use of the piezo alarm 44 with the driving circuit 110 is presently preferred for simplicity, decreased power consumption and overall dependability.

Of course, although the present invention has been described in terms of circuit-based embodiments, the present invention can be implemented in a number of suitable configurations. For instance, the circuit preferably is placed on a printed circuit board. The functions of the circuit also can be replicated through software embodiments, can be done through solid-state electronics, and through any of a variety of configurable controllers. Moreover, although the present invention has been described in terms of certain arrangements, other arrangements apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A water leak detection and correction device comprising:

a power source comprising a first terminal and a second terminal;

a first relay coil comprising a first terminal and a second terminal, said first terminal of said power source being connected to said first terminal of said first relay coil;

a liquid sensor comprising a first terminal and a second terminal, said first terminal of said liquid sensor being connected to said second terminal of said first relay coil, said liquid sensor not comprising an amplifying circuit;

a reset switch comprising a first terminal and a second terminal, said first terminal of said reset switch being connected to said second terminal of said liquid sensor and said second terminal of said reset switch being connected to said second terminal of said power source;

a first normally open relay comprising a first terminal and a second terminal; said first terminal of said first relay being connected to said first terminal of said power source;

a first electrically operated valve comprising a fist terminal and a second terminal, said first terminal of said first valve being connected to said second terminal of said fist relay and said second terminal of sad first valve being connected to said second terminal of said power source;

said first relay being operatively controlled by said first relay coil such that said first relay is closed when current flows through said first relay coil;

a second normally open relay comprising a first terminal and a second terminal; said first terminal being connected to said first terminal of said power source and said second terminal being connected to said first terminal of said reset switch such that when said second relay is closed power is supplied to said test relay coil even if said liquid sensor no longer senses liquid;

a third normally open relay comprising a first terminal and a second terminal, said first terminal being connected to said fist teal of said power source, said second relay and third relay being controlled by said first relay coil; and an alarm circuit comprising a first terminal and a second terminal, said first terminal of said alarm circuit being connected to said second terminal of said third relay and said second terminal of said alarm circuit being connected to said second terminal of said power source.

2. A water leak detection and correction device comprising:

a power source comprising a first terminal and a second terminal;

a rectifier comprising a first terminal, a second terminal, a third terminal and a fourth terminal, the first terminal of the rectifier being connected to the first terminal of the power source, the second terminal of the rectifier being connected to the second terminal of the power source, a first relay coil comprising a first terminal and a second terminal, said third terminal of said rectifier being connected to said first terminal of said first relay coil;

a second relay coil comprising a first terminal and a second terminal, said third terminal of said rectifier being connected to said first terminal of said second relay coil;

a liquid sensor comprising a first terminal and a second terminal, said first terminal of said liquid sensor being connected to said second terminal of said first relay coil and to said second terminal of said second relay coil, said liquid sensor not comprising an amplifying circuit;

a reset switch comprising a first terminal and a second terminal, said first terminal of said reset switch being connected to said second terminal of said liquid sensor and said second terminal of said reset switch being connected to said fourth terminal of said rectifier;

a test switch comprising a first terminal and a second terminal; said first terminal of said test switch being connected to said second terminal of said first relay coil and said second terminal of said second relay coil, said second terminal of said test switch being connected to said first terminal of said reset switch;

a first normally open relay comprising a first terminal and a second terminal; said first terminal of said first relay being connected to said first terminal of said power source a second normally open relay comprising a first terminal and a second terminal; said first terminal of said second relay being connected to said first terminal of said power source;

a first electrically operated valve comprising a first terminal and a second terminal, said first terminal of said first valve being connected to said second terminal of said first relay and said second terminal of said first valve being connected to said second terminal of said power source;

a second electrically operated valve comprising a first terminal and a second terminal, said first terminal of said second valve being connected to said second terminal of said second relay and said second terminal of said second valve being connected to said second terminal of said power source;

said first relay and said second relay being operatively controlled by said first relay coil such that said first relay and said second relay are closed when current flows through said first relay coil;

a third normally open relay comprising a first terminal and a second terminal; said first terminal being connected to said third terminal of said rectifier and said second terminal being connected to said first terminal of said reset switch such that when said third relay is closed power is supplied to said first relay coil and said second relay coil even if said liquid sensor no longer senses liquid;

a fourth normally open relay comprising a first terminal and a second terminal, said first terminal being connected to said third terminal of said rectifier, said third relay and fourth relay being controlled by said second relay coil; and an alarm circuit comprising a first terminal and a second terminal, said first terminal of said alarm circuit being connected to said second terminal of said fourth relay and said second terminal of said alarm circuit being connected to said fourth terminal of said rectifier.

3. The device of claim 2, wherein the device consists of four separable components, said first valve and said second valve being a first component, said power source comprising a power source enclosure and being a second component, said liquid sensor being a third component and a control enclosure being a fourth component, said control enclosure containing said rectifier, said first relay coil, said second relay coil, said first relay, said second relay, said third relay, said fourth relay, said test switch, said reset switch and said alarm circuit.

4. The device of claim 3, wherein said alarm circuit comprises a buzzer and a lamp, said lamp being visible through a portion of said enclosure.

5. The device of claim 3, wherein said liquid sensor comprises an elongate strip.

* * * * *